US005238465A

United States Patent [19]

Fritzsche

[11] Patent Number: 5,238,465

[45] Date of Patent: Aug. 24, 1993

[54] FIXING DYE HAVING POLYMERIZABLE RADICAL ON FIBER BY TREATMENT WITH IONIZING RADIATION IN PRESENCE OF COLORLESS MONOMER

[75] Inventor: Katharina Fritzsche, Weil am Rhein, Fed. Rep. of Germany

[73] Assignee: Ciba-Geigy Corporation, Ardsley, N.Y.

[21] Appl. No.: 727,513

[22] Filed: Jul. 9, 1991

[30] Foreign Application Priority Data

Jul. 12, 1990 [CH] Switzerland ..... 2325/90

[51] Int. Cl.[5] ..... D06P 1/38; D06P 5/20

[52] U.S. Cl. ..... 8/444; 8/405; 8/523; 8/543; 8/544; 8/549; 8/553; 8/555; 8/558; 8/647; 8/917; 8/926; 8/927; 8/928

[58] Field of Search ..... 8/444, 555, 647, 549

[56] References Cited

U.S. PATENT DOCUMENTS 2,897,101 7/1959 Graulich ..... 427/389.9
4,588,411 5/1986 Scheibli et al. ..... 8/528

FOREIGN PATENT DOCUMENTS 1316458 5/1973 United Kingdom .
1341199 12/1973 United Kingdom .

OTHER PUBLICATIONS

Textile Chemist and Colorist, vol. 10, pp. 220–224 (1978).
Textile Chemist and Colorist, vol. 11, pp. 107–113 (1979).

*Primary Examiner*—A. Lionel Clingman
*Attorney, Agent, or Firm*—Marla J. Mathias; George R. Dohmann

[57] ABSTRACT

The invention relates to a process for fixing dyes which contain at least one polymerisable double bond and/or at least one polymerisable ring system on moist fibre material using ionising radiation together with at least one colorless compound which contains at least one polymerisable double bond, but not N-$C_1$–$C_4$alkylolacrylamide or N,N-di($C_1$–$C_4$alkylol)acrylamide.

19 Claims, No Drawings

FIXING DYE HAVING POLYMERIZABLE RADICAL ON FIBER BY TREATMENT WITH IONIZING RADIATION IN PRESENCE OF COLORLESS MONOMER

The invention relates to a process for fixing dyes on fibre material by subjecting material which has been printed or dyed with dyes which contain polymerisable double bonds or polymerisable ring systems to ionising radiation together with at least one colourless compound which contains at least one polymerisable double bond.

It is known that dyes which contain activated unsaturated groups can be fixed to the fibre material by the action of ionising radiation. Unlike conventional processes for fixing dyes, in particular reactive dyes, fixation by radiation makes it possible for example to dispense completely with fixing baths and fixatives. A further advantage has been considered to the simultaneous application and fixing of dyes and textile finishes, for example for improving antistatic properties or the crease resistance or for reducing the soil retaining power. Furthermore, to improve the crosslinking of the dye and the fibre, polymerisable compounds have been added to the dyeing liquor and the dry fibre material has been irradiated for fixation. No increase in the fixation yield was detectable.

The practice of dyeing with reactive dyes in particular has in recent years led to increased expectations of the quality of the dyeing and the economics of the dyeing process. The degree of fixation of reactive dyes achievable with ionising radiation to longer meets the present-day requirements. It is consequently the object of the present invention to find an improved fixation process which also has the advantages of fixation by radiation.

It has been found that this object is achieved by the novel process.

The present invention accordingly provides a process for fixing dyes on fibre materials, which comprises fixing dyes which contain at least one polymerisable double bond and/or at least one polymerisable ring system on moist fibre material using ionising radiation together with at least one colourless compound which contains at least one polymerisable double bond, but not N-$C_1$-$C_4$alkylolacrylamide or N,N-di($C_1$-$C_4$alkylol)acrylamide.

The process of the present invention is notable in that the dye and colourless compound can be applied together, so that only a single dyebath or dyeing liquor is required and that the moist fibre material is subjected to ionising radiation without intermediate drying, which produces a distinctly higher degree of fixation than in existing processes without colourless polymerisable compound.

For the purposes of the present invention, moist fibre material is to be understood as meaning in particular fibre material which has a residual moisture content of greater than 30%, preferably 40–60%, based on the treated fibre material before irradiation.

The process of the present invention is substantially more economical in terms of auxiliaries and apparatus required, since, after the novel fixation process, no fixing alkali need be washed out; the dyed or printed fibre material needs only to be rinsed and dried.

The fixing process consists in subjecting a fibre material, for example a textile fibre material, after treatment with a dye which contains at least one polymerisable double bond and/or a polymerisable ring system in the moist state to ionising radiation for a short time in the presence of at least one colourless compound which contains at least one polymerisable double bond. The treatment of the fibre material with a dye of the type defined can be effected in a conventional manner, for example in the case of a textile fabric by impregnating with a dye solution in an exhaust bath or by spraying or padding, or by printing, for example on a roller printing machine.

For the purposes of the present invention, ionising radiation is to be understood as meaning a form of radiation which can be detected in an ionisation chamber. Ionising radiation consists either of electrically charged, directly ionising particles which in gases along their path produce ions by impact, or of uncharged, indirectly ionising particles or photons which in matter produce directly ionising charged secondary particles, such as the secondary electrons of X- or $\gamma$-rays or the recoil nuclei (in particular protons) of fast neutrons; indirectly ionising particles also include slow neutrons which by nuclear reactions can produce high-energy charged particles partly directly, partly via photons, from ($\beta$,$\gamma$)-processes. Examples of heavy charged particles are protons, atomic nuclei and ionised atoms. Of particular importance for the process of the present invention are light charged particles, for example electrons. Suitable X-rays include not only Bremsstrahlung but also characteristic radiation. An important form of heavy charged particles are $\alpha$-particles. The ionising radiation can be produced in a conventional manner. For instance, spontaneous nuclear transformations as well as nuclear reactions (forced nuclear transformations) can be used. Suitable sources of radiation accordingly include natural or artificial radioactive substances and in particular atomic reactors. The radioactive products produced in such reactors by nuclear fission represent a further important source of radiation.

A further suitable method of producing radiation is by means of an X-ray tube.

Ionising radiation also includes vacuum UV light (<200 nm).

Of particular importance are rays consisting of particles accelerated in the electric fields. Suitable sources here are thermal, electron impact, low voltage arc, cold cathode and high frequency ion sources.

Of particular importance for the process of the present invention are electron beams. They are produced by accelerating and focusing electrons released by a cathode by spark, field or photoemission or by electron ion bombardment. Sources are electron canons and accelerators of conventional design. Examples are known from the literature, for example International Journal of Electron Beam & Gamma Radiation Processing, in particular 1/89 pages 11–15 and Optik, 77 (1987), pages 99–104.

Suitable sources of electron beams also include $\beta$ emitters, for example strontium 90.

Another form of industrially advantageously usable ionising rays are $\gamma$-rays, which are readily producible in particular with cesium 137 or cobalt 60 isotope sources.

Suitable dyes for this fixing process are those which have an activated unsaturated group, in particular an unsaturated aliphatic group, e.g. vinyl, halovinyl, styryl, acryloyl or methacryloyl. Examples which may be mentioned of such groups are halogen-containing unsaturated groups, such as halomaleic acid and halopropiolic acid radicals, α- or β-bromo- or -chloro-acryloyl groups, halogenated vinylacetyl groups, halocrotonyl or halomethacryloyl groups. Other possible groups are those which are readily convertible, for example by elimination of hydrogen halide, into halogen-containing unsaturated groups, for example the dichloropropionyl or dibromopropionyl group. For the purposes of the present invention, halogen atoms are here fluorine, chlorine, bromine and iodine atoms and also pseudohalogen atoms, for example the cyano group. Good results are obtained with the process of the present invention using dyes which contain an α-bromoacryloyl group. As dyes which contain a polymerisable double bond it is preferable to use those which contain at least one acryloyl, α-bromoacryloyl, α-chloroacryloyl or vinylsulfonyl radical; very particularly preferably those which contain at least one acryloyl, α-bromoacryloyl or vinylsulfonyl radical. As dyes which contain a polymerisable ring system it is preferable to use those which contain at least one epoxide radical.

The chromophoric systems used can belong to various classes.

A preferred embodiment of the process of the present invention comprises using as dyes those of the formula $$D-(X)_m \quad (1)$$

where D is the radical of an organic dye of the monoazo or polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbimide series, X is a polymerisable double bond or a polymerisable ring system, and m is 1, 2, 3, 4, 5 or 6.

A particularly preferred embodiment of the process of the present invention comprises using dyes of the formula (1) where a) D is the radical of a formazan dye of the formula

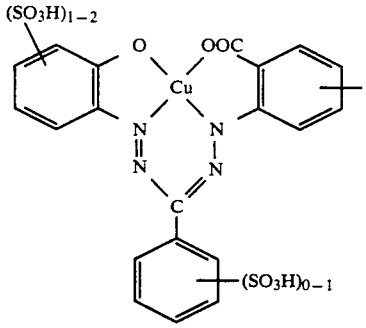

(2a)

or

-continued

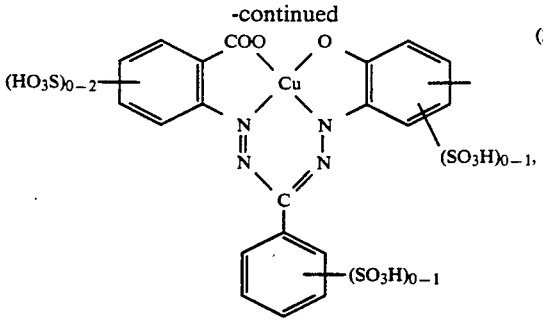

(2b)

where the benzene nuclei can be further substituted by alkyl of from 1 to 4 carbon atoms, alkoxy of from 1 to 4 carbon atoms, alkylsulfonyl of from 1 to 4 carbon atoms, halogen or carboxyl, b) D is the radical of an anthraquinone dye of the formula

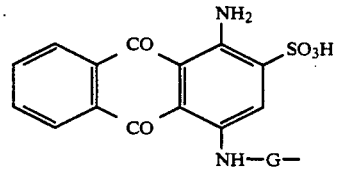

(3)

where G is a phenylene, cyclohexylene or $C_2$-$C_6$alkylene radical, the anthraquinone nucleus can be substituted by a further sulfo group, and phenyl G can be substituted by alkyl of from 1 to 4 carbon atoms, alkoxy of from 1 to 4 carbon atoms, halogen, carboxyl or sulfo, and the dye preferably contains at least 2 strongly water-solubilising groups.

c) D is the radical of a phthalocyanine dye of the formula

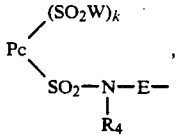

(4)

where Pc is the radical of a copper or nickel phthalocyanine; W is —OH and/or —$NR_5R_6$, $R_5$ and $R_6$ are each independently of the other hydrogen or alkyl of from 1 to 4 carbon atoms which can be substituted by hydroxyl or sulfo, $R_4$ is hydrogen or alkyl of from 1 to 4 carbon atoms, E is a phenylene radical which can be substituted by alkyl of from 1 to 4 carbon atoms, halogen, carboxyl or sulfo, or an alkylene radical of from 2 to 6 carbon atoms, preferably a sulfophenylene or ethylene radical, and k is 1, 2 or 3.

d) D is the radical of a dioxazine dye of the formula

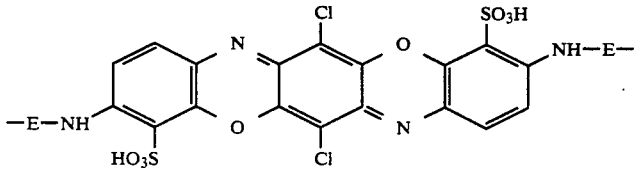

(5a)

or

-continued

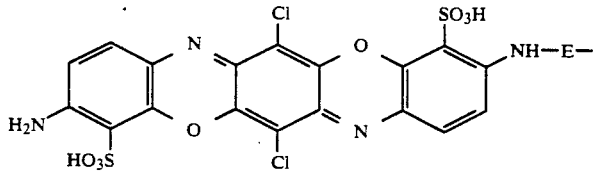

(5b)

where E is a phenylene radical which can be substituted by alkyl of from 1 to 4 carbon atoms, halogen, carboxyl or sulfo, or an alkylene radical of from 2 to 6 carbon atoms, and the outer benzene rings in the formulae (5a) and (5b) can be further substituted by alkyl of from 1 to 4 carbon atoms, alkoxy of from 1 to 4 carbon atoms, acetylamino, nitro, halogen, carboxyl or sulfo.

Particular preference is likewise given to dyes of the formula (1) where D is the radical of an azo dye, in particular a radical of the formulae 6 to 17:

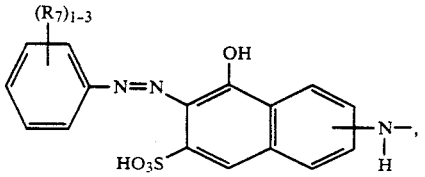

(6)

where $(R_7)_{1-3}$ represents from 1 to 3 substituents selected from the group consisting of $C_{1-4}$alkyl, $C_{1-4}$alkoxy, halogen, carboxyl and sulfo;

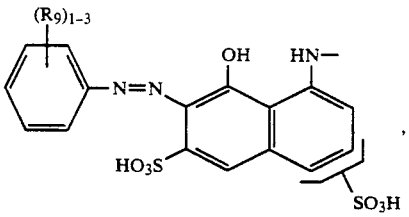

(7)

where $(R_9)_{1-3}$ represents from 1 to 3 substituents selected from the group consisting of $C_{1-4}$alkyl, $C_{1-4}$alkoxy, halogen, carboxyl and sulfo;

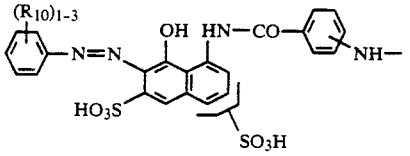

(8)

where $(R_{10})_{1-3}$ represents from 1 to 3 substituents selected from the group consisting of $C_{1-4}$alkyl, $C_{1-4}$alkoxy, halogen, carboxyl and sulfo;

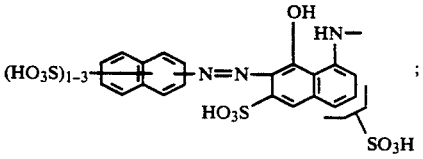

(9)

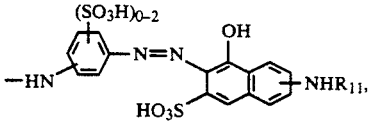

(10)

where $R_{11}$ is $C_{2-4}$alkanoyl or benzoyl;

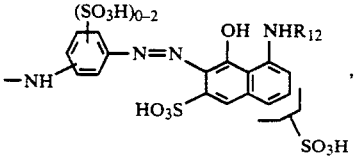

(11)

where $R_{12}$ is $C_{2-4}$alkanoyl or benzoyl;

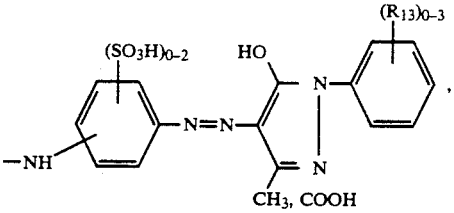

(12)

where $(R_{13})_{0-3}$ represents from 0 to 3 substituents selected from the group consisting of $C_{1-4}$alkyl, $C_{1-4}$alkoxy, halogen, carboxyl and sulfo;

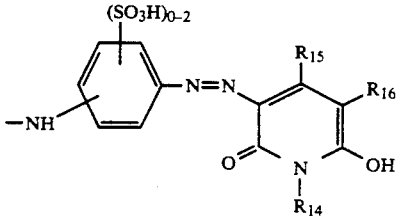

(13)

where $R_{14}$ and $R_{15}$ are each independently of the other hydrogen, $C_{1-4}$alkyl or phenyl, and $R_{16}$ is hydrogen, cyano, carbamoyl or sulfomethyl;

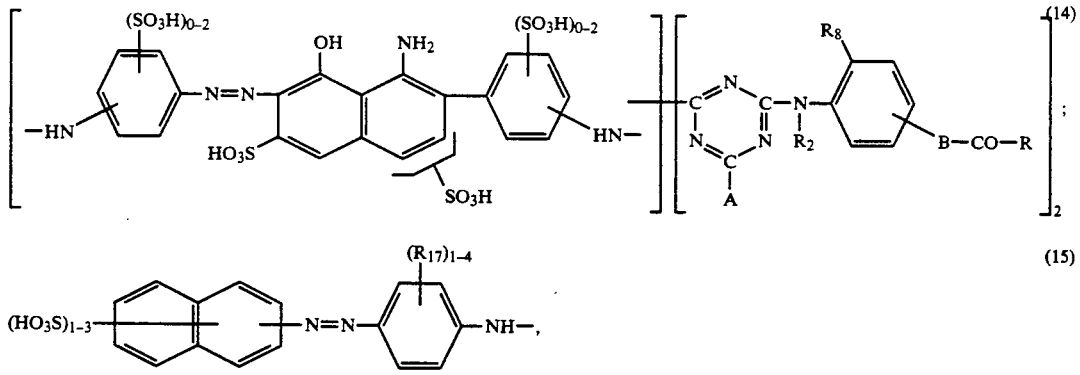

(14)

(15)

where $(R_{17})_{1-4}$ represents from 1 to 4 substituents selected from the group consisting of hydrogen, halogen, nitro, cyano, trifluoromethyl, sulfamoyl, carbamoyl, $C_{1-4}$alkyl, $C_{1-4}$alkoxy, amino, acetylamino, ureido, hydroxyl, carboxyl, sulfomethyl and sulfo, independently of one another;

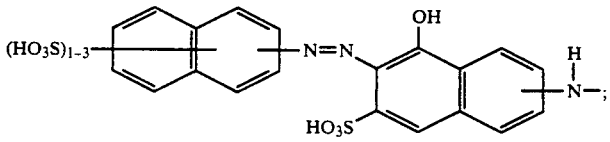

(16)

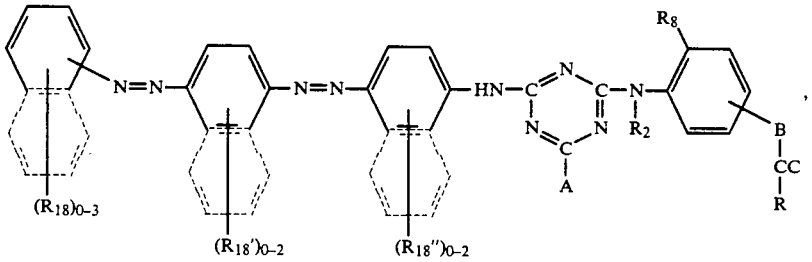

(17)

where $(R_{18})_{0-3}$, $(R_{18'})_{0-2}$ and $(R_{18''})_{0-2}$ each represent independently of one another from 0 to 3 or from 0 to 2 substituents selected from the group consisting of $C_{1-4}$alkyl, $C_{1-4}$alkoxy and sulfo.

Preferably, the colourless compounds used in the process of the present invention are monomeric, oligomeric or polymeric organic compounds or mixtures thereof.

Particularly preferably, the colourless compounds used in the process of the present invention are acrylates, diacrylates, acrylic acid or acrylamides.

Very particularly preferably, the process of the present invention is carried out using mixtures of monomeric and oligomeric colourless organic compounds.

The colourless organic compounds which contain at least one polymerisable double bond are free of colouring radicals. They are monomeric, oligomeric or polymeric organic compounds or a mixture thereof which are capable of undergoing polymerisation or crosslinking under the action of ionising radiation.

A suitable monomeric colourless compound is one having a molecular weight of up to about 1000 and containing at least one polymerisable group.

Bi-, tri- and polyfunctional monomers are likewise suitable.

The monomeric colourless compound can be used not only alone but also mixed with other monomers, oligomers and/or polymers.

A suitable oligomeric colourless compound is one having a molecular weight between 1000 and 10,000 and containing one or more polymerisable groups. The oligomeric colourless compound can be used alone, if liquid, or in the form of a solution in water or organic solvents or in the form of a mixture with other monomers, oligomers and/or polymers.

A suitable polymeric colourless compound is one having a molecular weight $>10,000$ and containing one or more polymerisable groups.

The polymeric colourless compound can be used alone, if liquid, or in the form of a solution in water or organic solvents or in the form of a mixture with other monomers, oligomers and/or polymers.

Suitable colourless compounds are ethylenically unsaturated monomeric, oligomeric and polymeric compounds.

Of particular suitability are for example esters of ethylenically unsaturated carboxylic acids and polyols or polyepoxides and polymers having ethylenically unsaturated groups in the backbone or in side groups, for example unsaturated polyesters, polyamides and polyurethanes and copolymers thereof, polybutadiene and butadiene copolymers, polyisoprene and isoprene copolymers, polymers and copolymers having (meth-)acryloyl groups in side chains, and also mixtures of one or more such polymers.

Examples of unsaturated carboxylic acids are acrylic acid, methacrylic acid, crotonic acid, itaconic acid, cinnamic acid and unsaturated fatty acids such as linolenic acid or oleic acid. Preference is given to acrylic acid and methacrylic acid.

Suitable polyols are aliphatic and cycloaliphatic polyols. Examples of polyepoxides are those based on polyols and epichlorohydrin. As polyols it is also suitable to use polymers or copolymers which contain hydroxyl groups in the polymer chain or in side groups, for example polyvinyl alcohol and copolymers thereof or poly(-hydroxyalkyl methacrylate)s or copolymers thereof. Further suitable polyols are oligoesters having hydroxyl end groups.

Examples of aliphatic and cycloaliphatic polyols are alkylenediols of preferably from 2 to 12 carbon atoms, such as ethylene glycol, 1,2- or 1,3-propanediol, 1,2-, 1,3- or 1,4-butanediol, pentanediol, hexanediol, octanediol, dodecanediol, diethylene glycol, triethylene glycol, polyethylene glycols having molecular weights of preferably from 200 to 1500, 1,3-cyclopentanediol, 1,2-, 1,3- or 1,4-cyclohexanediol, 1,4-dihydroxymethylcyclohexane, glycerol, tris(β-hydroxyethyl)amine, trimethylolethane, trimethylolpropane, pentaerythritol, dipentaerythritol and sorbitol.

The polyols can be partially or completely esterified with one or more unsaturated carboxylic acids, in which case, in partial esters, the free hydroxyl groups can be modified, for example esterified, or esterified with other carboxylic acids.

Examples of esters are: trimethylolpropane triacrylate, trimethylolethane triacrylate, trimethylolpropane trimethacrylate, trimethylolethane trimethacrylate, tetramethylene glycol dimethacrylate, triethylene glycol dimethacrylate, tetraethylene glycol disacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol pentaacrylate, dipentaerythritol hexaacrylate, tripentaerythritol octaacrylate, pentaerythritol dimethacrylate, pentaerythritol trimethacrylate, dipentaerythritol dimethacrylate, dipentaerythritol tetramethacrylate, tripentaerythritol octamethacrylate, pentaerythritol diitaconate, dipentaerythritol trisitaconate, dipentaerythritol pentaitaconate, dipentaerythritol hexaitaconate, ethylene glycol dimethacrylate, 1,3-butanediol diacrylate, 1,3-butanediol dimethacrylate, 1,4-butanediol diitaconate, sorbitol triacrylate, sorbitol tetraacrylate, pentaerythritol modified triacrylate, sorbitol tetramethacrylate, sorbitol pentaacrylate, sorbitol hexaacrylate, oligoester acrylates and -methacrylates, glycerol di-and triacrylate, 1,4-cyclohexane diacrylate, bisacrylates and bismethacrylates of polyethylene glycol of molecular weight 200–1500, or mixtures thereof.

Suitable colourless compounds also include the amides of identical or different unsaturated carboxylic acids with aromatic, cycloaliphatic and polyaliphatic amines having preferably from 2 to 6, in particular from 2 to 4, amino groups. Examples of such polyamines are ethylenediamine, 1,2- or 1,3-propylenediamine, 1,2-, 1,3- or 1,4-butylenediamine, 1,5-pentylenediamine, 1,6-hexylenediamine, octylenediamine, dodecylenediamine, 1,4-diaminocyclohexane, isophoronediamine, phenylenediamine, bisphenylenediamine, di-β-aminoethyl ether, diethylenetriamine, triethylenetetramine, di(β-aminoethoxy)ethane and di(β-aminopropoxy)ethane. Other suitable polyamines are polymers or copolymers having amino groups in the side chain and oligoamides having amino end groups.

Examples of such unsaturated amides are: methylenebisacrylamide, 1,6-hexamethylenebisacrylamide, diethylenetriaminetrismethacrylamide, bis(methacrylamidopropoxy)ethane, β-methacrylamidoethyl methacrylate and N-[(β-hydroxyethoxy)ethyl]acrylamide.

Suitable unsaturated polyesters and polyamides are derived for example from maleic acid and diols or diamines. The maleic acid may be replaced in part by other dicarboxylic acids. They can be used together with ethylenically unsaturated comonomers, for example styrene. Polyesters and polyamides can also be derived from dicarboxylic acids and ethylenically unsaturated diols or diamines, in particular from long-chain ones with, for example from 6 to 20 carbon atoms. Examples of polyurethanes are those formed from saturated or unsaturated diisocyanates and unsaturated or saturated diols.

Polybutadiene and polyisoprene and copolymers thereof are known. Suitable comonomers are for example olefins such as ethylene, propene, butene, hexene, (meth)acrylates, acrylonitrile, styrene and vinyl chloride. Polymers having (meth)acrylate groups in the side chain are likewise known. They can be for example novolak-based epoxy resins with (meth)acrylic acid, homopolymers or copolymers of polyvinyl alcohol or hydroxyalkyl derivatives thereof which have been esterified with (meth)acrylic acid, or homopolymers or copolymers of (meth)acrylates which have been esterified with hydroxyalkyl (meth)acrylates.

The colourless compounds can be used alone or in any desired mixtures.

Preferred oligomeric or polymeric colourless compounds are various polyester acrylates, e.g. $CH_2{=}CH{-}[CO{-}O(CH_2)_n]{-}CO{-}O{-}CH{=}CH_2$, epoxy acrylates, e.g. $(CH_2{=}CH{-}CO{-}O{-}CH_2{-}CHOH{-}CH_2{-}O{-}C_6H_6)_2C(CH_3)_2$, urethane acrylates, e.g.

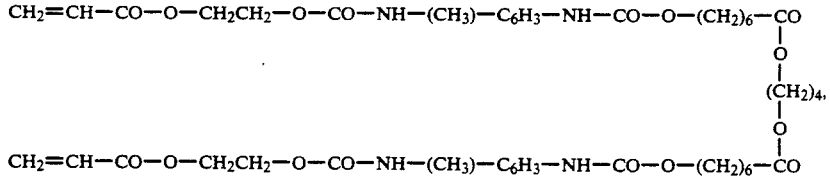

polyether acrylates, e.g.

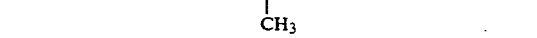

and silicone acrylates, known for example from Textilpraxis International (1987) pages 848–852.

A preferred embodiment of the process of the present invention comprises using as colourless compounds those having the acryloyl radical as polymerisable group, in which case oligomeric polyether, polyurethane and polyester acrylates are particularly preferred.

In the processes of the present invention, the colourless monomeric compound used is in particular N-vinylpyrrolidine, acrylic acid, butyl acrylate, 2-ethylhexyl acrylate, 2-hydroxyethyl acrylate, hydroxypropyl acrylate, butanediol monoacrylate, 2-ethoxyethyl acrylate, ethylene glycol acrylate, butanediol acrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacrylate, pentaerythritol triacrylate, bromoacrylamide, methylenebisdi(-bromoacrylamide), methylenebisdiacrylamide, N-alkoxyacrylamides, tetraethylene glycol diacrylate, soya bean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, ditrimethylolpropane pentaacrylate, tris(2-hydroxyethyl)isocyanurate triacrylate, isodecyl acrylate, dipentaerythritol pentaacrylate, ethoxylated trimethylolpropane triacrylate, isobornyl acrylate, ethoxylated tetrabromobisphenol diacrylate, propoxylated neopentylglycol diacrylate or propoxylated glyceryl triacrylate.

The process of the present invention can be used on a wide range of fibres, for example fibres of animal origin such as wools, silks or hairs (for example in the form of felt) or regenerated noncelluloric fibres, such as protein fibres or alginate fibres, synthetic fibres, such as polyvinyl, polyacrylonitrile, polyester, polyamide or polyurethane fibres, polypropylene and in particular cellulose-containing materials, such as bast fibres, e.g. linen, hemp, jute, ramie and in particular cotton, and also regenerated cellulosics, such as viscose or modal fibres, cuprammonium, nitrate or hydrolysed acetate fibre or fibres made of cellulose acetate or cellulose triacetate, such as Arnel®, Trilan®, Courpleta® or Tricel®, or else inorganic fibres, for example glass fibres.

The fibres mentioned can be present in forms as used in particular in the textile industry, for example in the form of filaments or yarns or as woven fabric, knitted fabric or weblike materials, such as felts.

The process of the present invention is carried out by passing textile material which has been treated for example with dye solution and the solution of a colourless compound in the moist state through the fanned-out beam of an electron accelerator at room temperature. This is done at such a speed that a certain irradiation dose is obtained. The irradiation doses normally to be employed range between 0.1 and 25 Mrad, advantageously between 1 and 10 Mrad. If the dose is less than 1 Mrad the degree of fixation is generally too small, while a dose of more than 25 Mrad frequently causes damage to the fibre material and the dye. It is advantageous prior to irradiation to squeeze a fabric which has been impregnated with dye solution and the solution of a colourless compound to a lower liquor content on a pad-mangle and to leave it to itself for a certain period, depending on the diffusion power of the specific dye, for example from 15 minutes to 24 hours. The dye concentrations of the dye solutions or print pastes used can be chosen as for conventional dyeing or printing processes, for example from 0.001 to 10 per cent by weight on weight of fibre. After the treatment with the ionising radiation the treated material need only be washed and dried. The attainable degrees of fixation are high, for example more than 75%. The process of the present invention produces dyeings having generally good properties, for example good wash and light fastness properties.

In the practice of the process of the present invention it is of course necessary to take account of the particular technical conditions which apply. For instance, the specific embodiment depends in particular on the nature of the ionising radiation to be used and the method of generation thereof. If for example a yarn reel which has been impregnated with dye solution and the solution of the colourless compound is to be subjected to $\gamma$-rays, it is irradiated enclosed in a cell. If high irradiation doses are to be achieved with low-intensity radiation, the material to be irradiated can be subjected to radiation in a plurality of passes.

To preempt oxidative destruction of the dye it is advantageous in some cases to carry out the irradiation in the atmosphere of an inert protective gas, for example under nitrogen. However, in general such a measure is not necessary.

A preferred embodiment of the process of the present invention comprises effecting not only the fixation of appropriate dyes to the fibre material but also the dyeing or printing continuously.

The preferred fibre material for the processes of the present invention is wool, silk, hairs, alginate fibres, polyvinyl, polyacrylonitrile, polyester, polyamide, polypropylene or polyurethane fibres, cellulose-containing fibres or glass fibres.

Particular preference is given to using dyed or printed cellulose fibres and also polyester-cellulose blend fabrics.

In the embodiment examples which follow, radiation doses are expressed in the usual manner in Mrad (megarad), where 1 rad corresponds to an absorption of $10^{-2}$ J/kg (joule/kg). The fabric specified in the examples which follow is printed on one side or dyed by the pad-batch process and irradiated with accelerated electrons (acceleration voltage ~ 165 kV) under a protective gas atmosphere. Prints are irradiated on one side and dyeings in two passes on both sides. After irradiation, the dyeings and prints are washed off as usual for reactive dyes.

The degrees of fixation are determined by dissolving the dye off an irradiated sample which has not been washed off and off a nonirradiated sample. The samples are treated once with 50 ml of a solution of 600 ml/l of phosphate buffer (pH 7) and 40 ml/l of tetramethylurea in demineralised water at 40° C. and then with 50 ml of this solution at 100° C. for 30 minutes. The two extracts are combined and the degrees of fixation are determined via the absorbance (at $\lambda_{max}$).

EXAMPLE 1

A cotton satin fabric is padded with an aqueous solution containing 30 g/kg of the dye of the formula

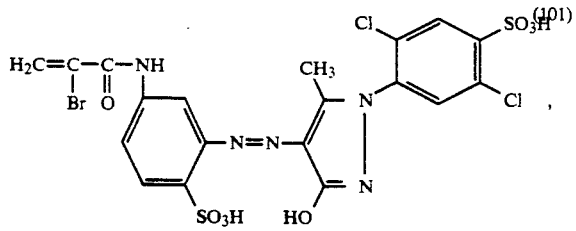

(101)

50 g/kg of an oligoethylene glycol diacrylate of molecular weight 508 and 100 g/kg of urea (wet pick-up 67%). The wet fabric is irradiated from both sides with accelerated electrons to a dose of 4 Mrad per side. The result obtained is a yellow dyeing of high fastness with a degree of fixation of 83%.

EXAMPLE 2

A wool gaberdine fabric is padded with an aqueous solution containing 30 g/kg of the dye of the formula

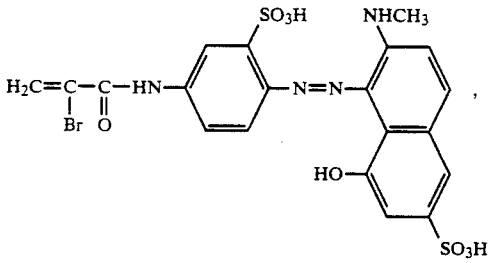

50 g/kg of an oligoethylene glycol diacrylate of molecular weight 508 and 100 g/kg of urea (wet pick-up 76%). The fabric is then irradiated as specified in Example 1. The result obtained is a red dyeing of high fastness having a degree of fixation of 77%.

EXAMPLE 3

A silk crêpe fabric is padded with an aqueous solution as specified in Example 2 (wet pick-up 110%) and irradiated with accelerated electrons as specified in Example 1. The result obtained is a red dye of high fastness having a degree of fixation of 78%.

EXAMPLE 4

A glass fibre fabric is padded as specified in Example 2 (wet pick-up 21%) and irradiated with accelerated electrons as specified in Example 1. The result obtained is a dyeing of high fastness having a degree of fixation of 86%.

EXAMPLE 5

A viscose staple fabric is padded as described in Example 2 (wet pick-up 86%) and irradiated with accelerated electrons as specified in Example 1. The result obtained is a red dyeing of high fastness having a degree of fixation of 88%.

EXAMPLE 6

A cotton satin fabric is printed with a print paste containing 30 g/kg of the dye of the formula (102), 100 g/kg of urea, 50 g/kg of an oligoethylene glycol diacrylate of molecular weight 508 and 30 g/kg of sodium alginate and irradiated on the top with accelerated electrons to a dose of 4 Mrad. The result obtained is a red print of high fastness having a degree of fixation of 65%.

EXAMPLE 7

A cotton satin fabric is padded with 30 g/kg of the dye of the formula

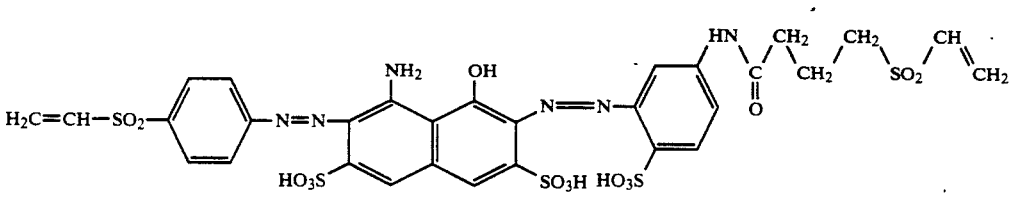

50 g/kg of the oligoethylene glycol diacrylate specified in Example 1 and 100 g/kg of urea (wet pick-up 70%) and irradiated with accelerated electrons as specified in Example 1. The result obtained is a blue dyeing of high fastness having a degree of fixation of 54%.

EXAMPLE 8

A cotton satin fabric is padded with 30 g/kg of the dye specified in Example 2, 50 g/kg of N-vinylpyrrolidone and 100 g/kg of urea as specified in Example 1 (wet pick-up 71%) and irradiated with accelerated electrons as specified in Example 1. The result obtained is a red dyeing of high fastness having a degree of fixation of 69%.

EXAMPLE 9

A cotton satin fabric is padded with an aqueous solution containing 30 g/kg of the dye specified in Example 2 and 50 g/kg of methylenebisacrylamide (wet pick-up 68%) and irradiated with accelerated electrons as specified in Example 1. The result obtained is a red dyeing of high fastness having a degree of fixation of 83%.

EXAMPLE 10

A viscose staple fabric is irradiated with an aqueous solution containing 30 g/kg of the dye of the formula

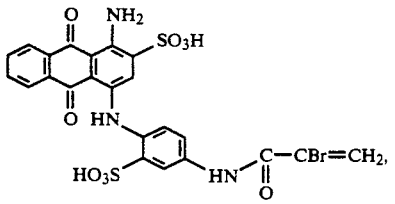

(104)

50 g/kg of an oligoethylene glycol diacrylate of molecular weight 508 and 100 g/kg of urea (wet pick-up 88%) and irradiated with accelerated electrons as specified in Example 1. The result obtained is a blue dyeing of high fastness having a degree of fixation of 76%.

COMPARATIVE EXAMPLE

Example 10 is repeated, except that a solution without 50 g/kg of the oligoethylene glycol diacrylate of molecular weight 508 is used. This produces on irradiation a blue dyeing having a degree of fixation of only 39%.

EXAMPLE 11

A cotton satin fabric is padded with an aqueous solution containing 30 g/kg of the dye of the formula

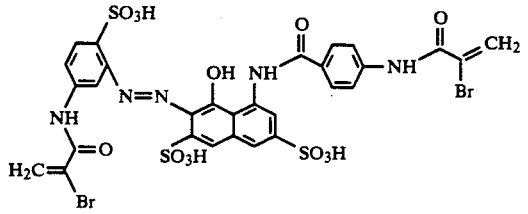

50 g/kg of an oligoethylene glycol diacrylate, 50 g/kg of a polyester acrylate and 100 g/kg of urea (wet pick-up about 70%). The wet fabric is irradiated from both sides with accelerated electrons to a dose of 4 Mrad per side. The result obtained is a dyeing of high fastness having a degree of fixation of 90%.

EXAMPLE 12

A cotton satin fabric is padded with an aqueous solution containing 30 g/kg of the dye described in Example 11, 50 g/kg of an oligoethylene glycol diacrylate, 50 g/kg of methylenebisacrylamide and 100 g/kg of urea and irradiated as described in Example 11. The result obtained is a dyeing of high fastness having a degree of fixation of 95%.

EXAMPLE 13

A cotton satin fabric is padded with an aqueous solution containing 30 g/kg of the dye described in Example 11, 50 g/kg of an oligoethylene glycol diacrylate, 50 g/kg of an oligoether triacrylate and 100 g/kg of urea and irradiated as described in Example 11. The result obtained is a dyeing of high fastness having a degree of fixation of 90%.

EXAMPLE 14

A cotton satin fabric is padded with an aqueous solution containing 30 g/kg of the dye described in Example 11, 50 g/kg of an oligoethylene glycol diacrylate, 50 g/kg of 2-ethyl(2-hydroxymethyl)-1,3-propanediol triacrylate and 100 g/kg of urea and irradiated as described in Example 11. The result obtained is a deep red dyeing of high fastness having a degree of fixation of 85%.

What is claimed is:

1. A process for fixing dyes on fiber materials, which comprises fixing a dye, which contains at least one polymerizable double bond and/or polymerizable ring system, on fiber material having a moisture content of more than 30%, based on treated fiber material before irradiation, using ionising radiation together with a colorless compound selected from the group consisting of N-vinyl-pyrrolidone, acrylic acid, butyl acrylate, 2-ethylhexyl acrylate, 2-hydroxyethyl acrylate, hydroxypropyl acrylate, butanediol monoacrylate, 2-ethoxyethyl acrylate, ethylene glycol acrylate, a bisacrylate of a polyethylene glycol having a molecular weight of from 200 to 1500, butanediol diacrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacrylate, pentaerythritol triacrylate, bromoacrylamide, methylenebisdi(bromoacrylamide), methylenebisdiacrylamide, N-alkoxyacrylamides, tetraethylene glycol diacrylate, soya bean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, ditrimethylolpropane tetraacrylate, tris(2-hydroxyethyl)isocyanurate triacrylate, isodecyl acrylate, dipentaerythritol pentaacrylate, ethoxylated trimethylolpropane triacrylate, isobornyl acrylate, ethoxylated tetrabromobisphenol diacrylate, propoxylated neopentylglycol diacrylate or propoxylated glyceryl triacrylate, wherein the colorless compound is present in an amount sufficient to improve the degree of fixation.

2. A process according to claim 1, wherein the colourless compounds used are monomeric, oligomeric or polymeric organic compounds or mixtures thereof.

3. A process according to claim 1, wherein the colourless compound is a mixture of monomeric and oligomeric colourless organic compounds.

4. A process according to claim 2, wherein the colourless compound includes one or more monomeric colourless compounds having a molecular weight of up to 1000.

5. A process according to claim 2, wherein the colourless compound includes one or more oligomeric colourless compounds having a molecular weight between 1000 and 10,000.

6. A process according to claim 1, wherein the colourless compound used is N-vinylpyrrolidone, methylenebisacrylamide or a bisacrylate of a polyethylene glycol having a molecular weight of from 200 to 1500.

7. A process according to claim 1, wherein the dyes used are those of the formula $$D—(X)_m \qquad (1),$$

where D is the radical of an organic dye of the monoazo or polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbimide series, X is a radical containing a polymerisable double bond or a polymerisable ring system, and m is 1, 2, 3, 4, 5 or 6.

8. A process according to claim 1, wherein the dyes used contain as polymerisable double bond or as polymerisable ring system an acryloyl, α-bromoacryloyl, α-chloroacryloyl, vinylsulfonyl or epoxy radical.

9. A process according to claim 8, wherein the dyes used contain as polymerisable double bond or as polymerisable ring system an acryloyl, α-bromoacryloyl or vinylsulfonyl radical.

10. A process according to claim 1, wherein the ionising radiation used comprises electron beams generated in a particle accelerator.

11. A process according to claim 1, wherein the dyes are fixed on the fibre material by dyeing or printing.

12. A process according to claim 1, wherein an irradiation dose of from 0.1 to 25 Mrad is chosen.

13. A process according to claim 1, wherein the irradiation is carried out under a protective gas atmosphere.

14. A process according to claim 1, wherein the fixation is carried out continuously.

15. A process according to claim 1, wherein not only the fixation of appropriate dyes to the fibre material but also the dyeing or printing are effected continuously.

16. A process according to claim 1, wherein the fibre material used is wool, silk, animal hairs, alginate fibres, polyvinyl, polyacrylonitrile, polyester, polyamide, polypropylene or polyurethane fibres, cellulose-containing fibres or glass fibres.

17. A process according to claim 16, wherein dyed or printed cellulose fibres or cellulose-containing fibres are used.

18. A process according to claim 16, wherein polyester-cellulose blend fabrics are used.

19. A dyed or printed fibre material subjected to fixation by the process of claim 1.

* * * * *